US005208568A

United States Patent [19]

Sassin

[11] Patent Number: 5,208,568

[45] Date of Patent: May 4, 1993

[54] METHOD FOR PRODUCING DIELECTRIC RESONATOR APPARATUS HAVING METALLIZED MESAS

[75] Inventor: Frederick L. Sassin, Albuquerque, N. Mex.

[73] Assignee: Motorola, Inc., Schaumburg, Ill.

[21] Appl. No.: 829,367

[22] Filed: Feb. 3, 1992

[51] Int. Cl.[5] ..... H01P 7/04; H01P 1/205

[52] U.S. Cl. ..... 333/223; 333/207; 29/600

[58] Field of Search ..... 333/202, 203, 206, 207, 333/222, 223, 235; 29/600

[56] References Cited

U.S. PATENT DOCUMENTS

| | | | |
|---|---|---|---|
| 4,431,977 | 2/1984 | Sokola et al. | 333/206 |
| 4,506,241 | 3/1985 | Makimoto et al. | 333/219.1 X |
| 4,668,925 | 5/1987 | Towatari et al. | 333/222 X |
| 4,692,726 | 9/1987 | Green et al. | 333/206 |
| 4,837,534 | 6/1989 | Van Horn | 333/207 |
| 4,937,542 | 6/1990 | Nakatuka | 333/202 |
| 5,004,992 | 4/1991 | Grieco et al. | 333/202 |

FOREIGN PATENT DOCUMENTS

| | | | |
|---|---|---|---|
| 62-43904 | 2/1987 | Japan . | |
| 0000801 | 1/1989 | Japan | 333/206 |
| 0321701 | 12/1989 | Japan | 323/222 |

*Primary Examiner*—Robert J. Pascal
*Assistant Examiner*—Seung Ham
*Attorney, Agent, or Firm*—James A. Coffing; Joseph P. Krause

[57] ABSTRACT

A dielectric resonator (400) is formed, according to the invention, from a block of dielectric material having top, bottom, and side surfaces. A protuberance (407) is formed on at least the top surface of the block. Further, a hole (405) is formed through the block, which hole extends substantially from the apex of the protuberance, through the block, to the bottom surface. The hole and protuberance combine to form a mesa structure (604, 704). The bottom surface, side surface, and an interior surface of the hole (405) are coated with a conductive layer. Further, a conductive coating is selectively disposed on the top surface of the block, which coating at least partially covers the mesa (604, 704). A dielectric block resonator (400, 500) is thereby formed whose resonant characteristics are at least partially determined by the physical dimensions of the mesa (604, 704).

5 Claims, 3 Drawing Sheets

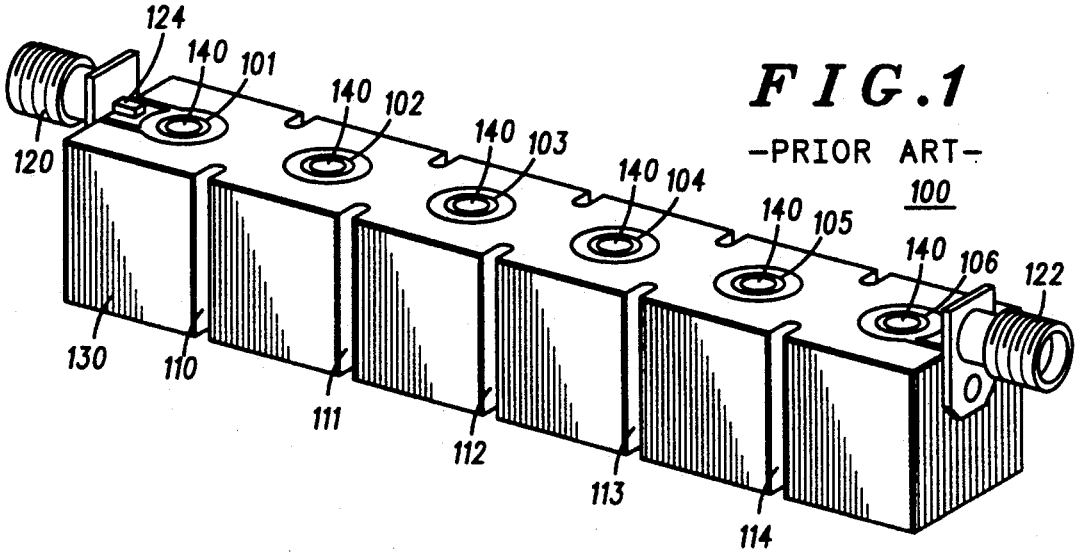
FIG. 1
-PRIOR ART-
FIG. 3
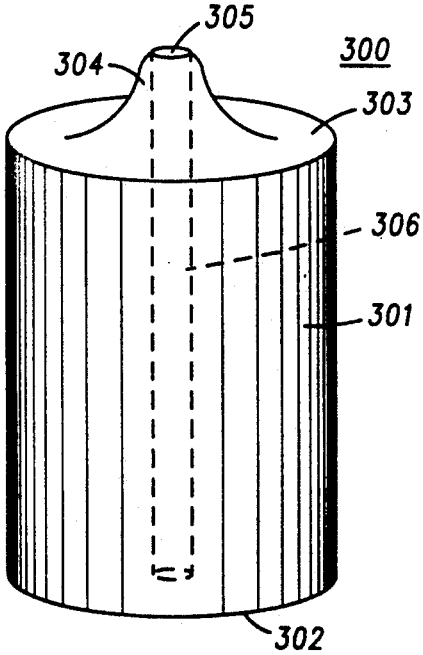
FIG. 2
-PRIOR ART-
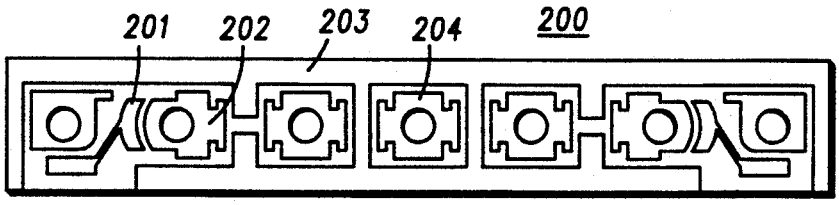

METHOD FOR PRODUCING DIELECTRIC RESONATOR APPARATUS HAVING METALLIZED MESAS

FIELD OF THE INVENTION

This invention relates generally to electrical signal filters, and in particular to so-called ceramic, or dielectric, resonators and filters.

BACKGROUND OF THE INVENTION

Prior art ceramic bandpass filters, such as that shown in FIG. 1 and described in U.S. Pat. No. 4,431,977, are typically constructed from blocks of ceramic material. The blocks are typically formed by pressing a ceramic-based powder, using a mold or other equivalent, to form a solid structure. The resulting structure may then be cured, or fired, to form a rigid block of ceramic. The block, including any number of through holes (e.g., holes 140 shown in FIG. 1) which make up the individual resonator structures, is then selectively coated with a conductive metallization layer. The coating is typically applied to the block so as to provide a shorted, typically one-quarter wavelength, transmission line resonator with each of the holes. Further processing of the metallization, as next described, is required to tune the resonator/filter to the desired frequency characteristics.

FIG. 2 shows a top view of a prior art ceramic block filter having an intricate metallization pattern on the top surface. The filter 200 is described in U.S. Pat. No. 4,692,726 (issued to Green et al. on Sep. 8, 1987, and assigned to the assignee of the present invention). The metallization pattern on the top surface of a dielectric filter is commonly known to affect the capacitive loading on the top surface of the dielectric filter. The pattern may be made up of a ground plane coating (203), input/output pads (201), and various resonator pads (202, 204) which surround the hole resonators. By changing the thickness, area, and relative spacing among these metallized areas, the capacitive loading at the top of the block can be altered. Altering the capacitive top loading is a well-known method for frequency tuning dielectric resonators and filters, as the capacitive reactance plays a significant role in the overall frequency response characteristics (i.e. center frequency, bandwidth, etc.).

Detailed metallization patterns, like the one shown in FIG. 2 are typically screen printed, e.g., using a plating mask or similar article, onto the top surface of the block. The results of this process have proven to be greatly dependent on the registration of the block with respect to the plating mask. That is, even a slight mis-alignment between the mask and the block often results in a resonator which is either unusable, or one that needs a substantial amount of tuning to meet the required specifications. Most tuning techniques today involve removing portions of the metallized top-patterns, which operations are often manual (e.g., using a hand-held grinding tool). That is, wide process variations seen during the manufacture of such dielectric resonators (e.g., forming the block, deposition of the metallization patterns, and the manual tuning process) sum together to produce a resonator or filter whose electrical characteristics are widely variable. As in any other manufacturing process, wide process variation leads to reduced overall yields (i.e., number of products which meet the specifications and can be shipped), and increased manufacturing costs.

Accordingly, a need exists for a ceramic block resonator or filter, and method for electrically tuning such a resonator or filter, which is not constrained by the aforementioned shortcomings. In particular, where a ceramic block filter or resonator requires frequency tuning to tight tolerance, an improved apparatus and cost effective method for providing such tuning, would be an improvement over the prior art.

SUMMARY OF THE INVENTION

The present invention encompasses a dielectric resonator which is formed from a block of dielectric material having top, bottom, and side surfaces. A protuberance is formed on at least the top surface of the block. Further, a hole is formed through the block, which hole extends substantially from the apex of the protuberance, through the block, to the bottom surface. The hole and protuberance combine to form a mesa structure. The bottom surface, side surface, and an interior surface of the hole are coated with a conductive layer. Further, a conductive coating is selectively disposed on the top surface of the block, which coating at least partially covers the mesa. A dielectric block resonator is thereby formed whose resonant characteristics are at least partially determined by the physical dimensions of the mesa.

BRIEF DESCRIPTION OF THE DRAWINGS

FIG. 1 is an isometric view of a dielectric block filter which is known in the prior art.

FIG. 2 is a top view showing the metallization pattern on one surface of dielectric filter, which filter is known in the prior art.

FIG. 3 is an isometric view of a ceramic structure, which may be used in accordance with the present invention.

DETAILED DESCRIPTION OF A PREFERRED EMBODIMENT

Figure 4:
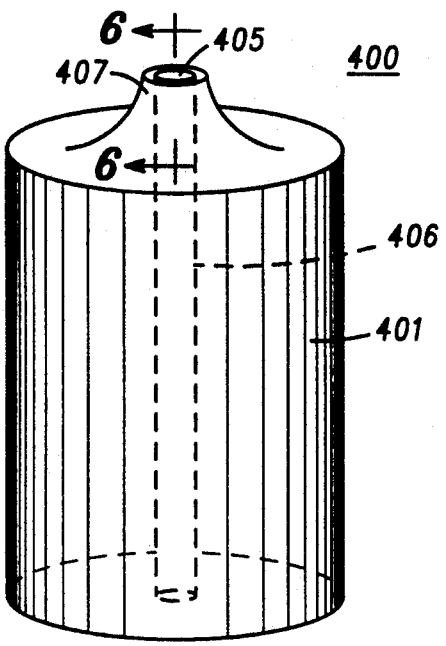
FIG. 4 is an isometric view of the structure of FIG. 3 after further processing, in accordance with the present invention.

FIG. 3 shows a ceramic structure 300, having a protuberance 304 formed on the top surface thereof, in accordance with one embodiment of the invention. (In a preferred embodiment, protuberance 304 is formed from the same material as the block, but it may be formed of any suitable dielectric material.) The structure 300 also includes a hole 305, which is preferably centered at the apex of the protuberance 304. Hole 305 extends through the apex of the protuberance 304, through the ceramic structure, to the bottom surface 302. Hole 305 further has an interior surface 306, which is substantially parallel with exterior surface 301 as shown. (The physical dimensions of the protuberance 304 will, as later described, be altered to affect an electrical tuning of the resonator during manufacture.)

Processing a ceramic block resonator from the structure shown in FIG. 3 requires the application of a conductive layer to at least some portions of the block. In a preferred embodiment, the entire structure, including all sides (301-303), protuberance 304, and interior surface 306 of hole 305, is coated with a conductive paste. (This can be done with a spraying process, or a dipping process, depending on the size and dimensions of the block.) The conductive paste (e.g., silver-glass paste such as Cermalloy C8710) is then cured to form a conductive metallization layer over the entire block. Further processing of the coated ceramic structure, as next described, will enable the coated structure to perform as a transmission line resonator, which performance is well established in the art.

Those skilled in the art of making ceramic resonators of this type are familiar with a physical grinding, (e.g., lapping, milling) process which is typically used to correct malformed blocks. For example, after the so-called firing process, the block may be somewhat mis-shaped, e.g., having concave or convex sides. Blocks processed (i.e. formed and fired) having sides which are not substantially flat, or which are concave or convex, typically result in filters having undesired electrical characteristics. Accordingly, the uncoated blocks are milled or lapped; a well known process which typically involves passing the surface to be corrected across an abrasive surface in order to remove undesired material. Repeated abrasion of the malformed surface results in a uniformly shaped parallelepiped which can then be processed to form a resonator or filter having desirable electrical characteristics. Similarly, a milling process may be used to provide an electrical discontinuity, or gap, between the inner surface 306 and the conductive sides of the protuberance 304. This gap in the metallization layer is required for the structure to behave like a transmission line resonator, and is provided by removing a top portion of the protuberance 304, as well as the metallization disposed thereon, as next described.

FIG. 4 shows a ceramic structure, such as the one shown in FIG. 3, which is coated with a conductive metallization layer and then milled in accordance with the invention. Milling protuberance 407 across a horizontal plane (i.e. parallel to the top and bottom surfaces of the block) removes the metallization on the upper portion of the structure. When the metallization on the upper surface of the protuberance 407 is completely removed, the desired gap is thereby created between the metallized interior surface 406 of hole 405, and the metallized side surface of protuberance 407. In addition to removing the metallization, further grinding reduces the height of the protuberance 407, which alters the capacitive reactance between these two metallized surfaces, as later described.

Figure 5:
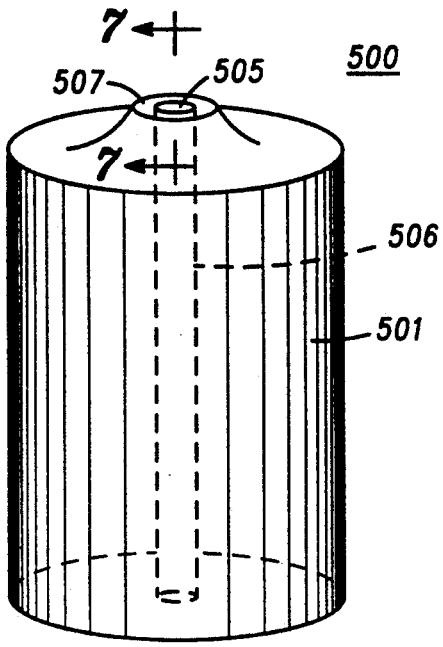
FIG. 5 is an isometric view of the structure of FIG. 4 after still further processing, in accordance with the present invention.
Figure 6:
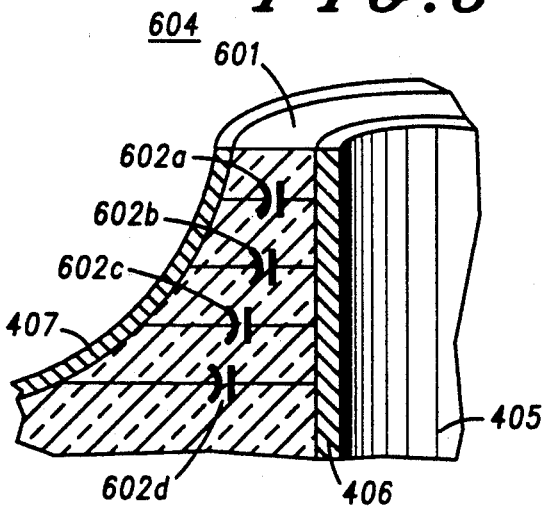
FIG. 6 is an isometric cross-sectional view of a portion of the structure of FIG. 4, in accordance with the present invention.

Referring ahead to FIG. 6, there is shown a partial cross-sectional view of the dielectric resonator 400 shown in FIG. 4, which view shows the mesa-like structure 604 formed after milling the protuberance 407. This mesa can be formed to have varying physical dimensions (i.e., height, width, surface areas, etc.), which physical dimensions play an important role in the resonant characteristics of the resonator. Milling through the metallization on the top of the mesa produces a capacitance between metallized layers 406 and 407 (i.e. approximating a simple parallel-plate capacitor) which capacitance is represented by reference numbers 602A-D. Further milling of the protuberance 407 produces a wider gap of dielectric separation between the metalized layer, and reduces the metallization layer areas, thereby altering the capacitance between these layers. The resulting structure is shown in FIG. 5, and described in more detail using FIG. 7.

Figure 7:
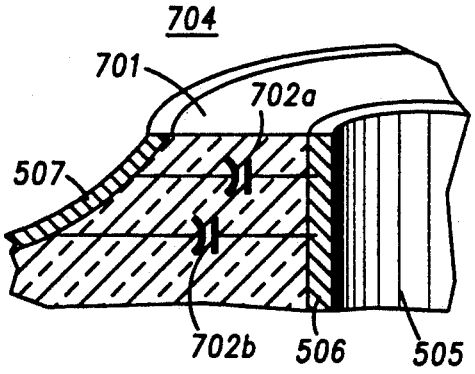
FIG. 7 is an isometric cross-sectional view of a portion of the structure of FIG. 5, in accordance with the present invention.

FIG. 7 shows a partial cross-sectional view of the top surface of resonator 500 shown in FIG. 5, which is formed by further milling the resonator 400 shown in FIG. 4. Capacitors 702A-B represent the effective capacitance between metallized interior surface 506 of hole 505 and the metallized protuberance 507. As mentioned earlier, altering the capacitance in this way results in predictable changes in the frequency response of the resonator. Therefore, by milling the surface of the protuberance 701, a method is provided for easily adjusting the frequency characteristics of the resonator. Accordingly, the (capacitive) top loading of the resonator can be altered by simply milling more or less material from the protuberance disposed on the top surface of the resonator.

It is well known in the electrical art that a desired filter response can be attained by placing resonator structures in parallel. These resonators may be integrally disposed within the same ceramic block or they may be independent structures, each having their own resonance characteristics. Dielectric filters are often constructed by forming dielectric resonators, and placing them in parallel, on the same dielectric block. Further, altering the capacitive top loading of such structures results in changes in the capacitive coupling between each resonator (thus changing the response characteristics of the filter).

Figure 8:
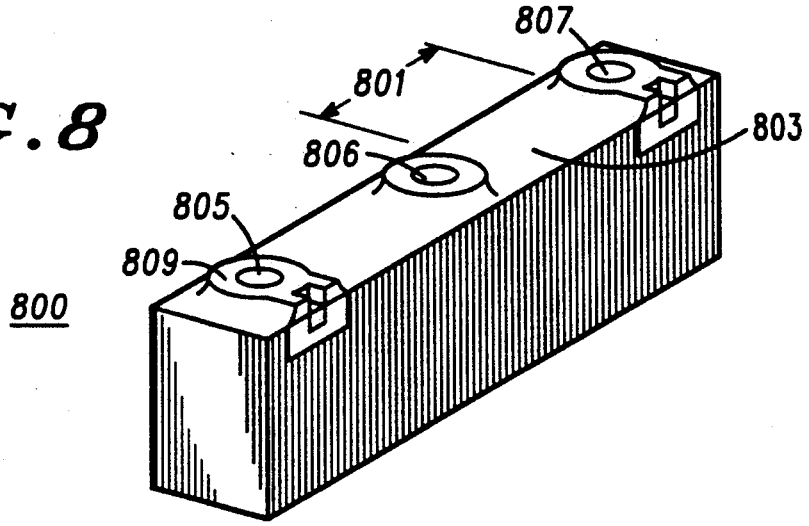
FIG. 8 is an isometric view of a dielectric filter, in accordance with one embodiment of the present invention.

FIG. 8 shows a dielectric resonator filter, or so-called combline filter, which employs the present invention. Filter 800 shows a parallelepiped ceramic block having three holes formed therethrough. The three holes 805, 806, 807 are separated by a distance 801, which distance affects the amount of inter-resonator coupling (this relationship is well understood in the art). In a preferred embodiment, the region 803 of the block between resonators 805, 806, 807 is coated with a conductive layer. Alternatively, region 803 may be selectively coated to alter the inter-resonator coupling, which in turn affects the frequency response characteristics of the filter (i.e. center frequency, transmission zeroes, bandwidth, etc.). Surface 809, i.e. an unmetallized annular region around hole 805 created by the milling process described herein, acts as a dielectric gap between the metallized hole 805 and the metallized sides of the mesa. Additionally, surface 809 is shown to be concentric with the resonator hole, but may vary in shape with respect to the hole to allow design flexibility. The relationship between the hole shape (e.g., round, square, elliptic, etc.) and the shape of the metallization around the hole is well known in the art and is therefore not addressed here.

Figure 9:
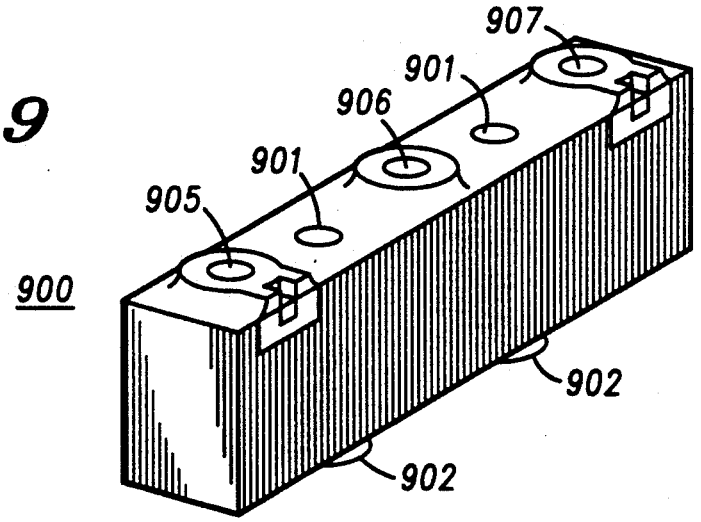
FIG. 9 is an isometric view of a dielectric filter, in accordance with an alternate embodiment of the present invention.

FIG. 9 shows an alternate embodiment of the present invention, which embodiment is in the form of an inter-digital filter 900. Inter-digital filters, whose response characteristics are well established in the art, are similar to the aforementioned combline structure except that alternating resonator sections are physically inverted within the block. That is, resonators 901, interposed among resonators 905–907 are inverted with respect to these resonators. Accordingly, the so-called top loading of resonators 901 is altered by processing protuberances 902 (located on the "bottom" of the dielectric block) with a metallization and milling operation similar to the one described above for the resonators and combline filter.

What is claimed is:

1. A method of altering resonant frequency characteristics of a dielectric resonator, the method comprising the steps of:

forming a volume of dielectric material having first, second, and side surfaces, at least said first surface further having a protuberance formed thereon;

forming a hole in said volume, such that said hole extends substantially from the apex of said protuberance through said dielectric material to said second surface;

coating said first, second, and side surfaces of said volume, said protuberance, and an interior surface of said hole with a conductive material;

removing at least a portion of the conductive material from said protuberance, such that a mesa having physical dimensions is formed by said hole and protuberance, thereby forming a dielectric hole resonator having frequency response characteristics: and altering the physical dimensions of the mesa such that the frequency response characteristics of the hole resonator are changed.

2. The method of claim 1, wherein said step of altering further comprises the step of mechanical milling.

3. A method of altering resonant characteristics of a dielectric filter, the method comprising the steps of:

forming a volume of dielectric material having first, second, and side surfaces, at least said first surface further having a plurality of protuberances disposed substantially collinearly thereon;

forming a plurality of holes in said volume, such that at least a first of said holes extends substantially from the apex of a first protuberance on said first surface through said dielectric material to said second surface;

coating said first, second, and side surfaces of said volume, at least said first protuberance, and an interior surface of at least said first hole, with a conductive material;

removing at least a portion of the conductive material from at least said first protuberance, such that a mesa having physical dimensions is formed by said first hole and said first protuberance, and thereby forming a dielectric filter having frequency response characteristics; and altering the physical dimensions of the mesa such that the frequency response characteristics of the dielectric filter are changed.

4. The method of claim 3, wherein said step of altering further comprises the step of mechanical milling.

5. A method of altering resonant characteristics of a dielectric filter, the method comprising the steps of:

forming a volume of dielectric material having first, second, and side surfaces, at least said first surface further having a plurality of protuberances disposed substantially collinearly thereon;

forming a plurality of holes in said volume, such that at least a first of said holes extends substantially from the apex of a first protuberance on said first surface through said dielectric material to said second surface;

coating said first, second, and side surfaces of said volume, at least said first protuberance, and an interior surface of at least said first hole, with a conductive material;

removing at least a portion of the conductive material from at least said first protuberance, such that a mesa having a predetermined height is formed by said first hole and said first protuberance, and thereby forming a dielectric filter having frequency response characteristics; and mechanically grinding a portion of the mesa, thereby reducing the predetermined height, such that the frequency response characteristics of the dielectric filter are changed.

* * * * *